United States Patent [19]

Autry et al.

[11] Patent Number: 4,747,220

[45] Date of Patent: May 31, 1988

[54] CLEATED SOLE FOR ACTIVEWEAR SHOE

[75] Inventors: James C. Autry, Dallas, Tex.; Lin Yung-Mao, Taichung, Taiwan

[73] Assignee: Autry Industries, Inc., Dallas, Tex.

[21] Appl. No.: 4,679

[22] Filed: Jan. 20, 1987

[51] Int. Cl.[4] ..... A43C 15/02; A43B 5/00

[52] U.S. Cl. ..... 36/59 R; 36/59 C; 36/114

[58] Field of Search ..... 36/59 R, 59 A, 59 B, 36/59 C, 19 R, 22 R, 22 A, 23, 24, 30 R, 103, 104, 113, 114

[56] References Cited

U.S. PATENT DOCUMENTS

| | | | |
|---|---|---|---|
| 429,429 | 6/1890 | Eckhardt | 36/59 R |
| 997,657 | 7/1911 | Drake | 36/59 A |
| 1,370,798 | 3/1921 | Egerton | 36/59 B |
| 4,392,312 | 7/1983 | Crowley et al. | 36/59 R |

FOREIGN PATENT DOCUMENTS 3035706 6/1982 Fed. Rep. of Germany .

*Primary Examiner*—Donald Watkins

*Attorney, Agent, or Firm*—Jerry W. Mills; Jefferson Perkins

[57] ABSTRACT

A novel sole construction (16) comprises an outsole (20) and a cleat layer (34) disposed above the outsole and having a plurality of cleats (22) depending therefrom. A plurality of perforations (38) are formed in the outside (20) each perforation (38) receiving a respective cleat (22) for insertion therethrough. Thus, the exterior bottom surface (18) of the sole construction (16) comprises a flexible, light weight outsole (20) with more durable cleats (22) disposed at strategic points therein.

6 Claims, 1 Drawing Sheet

10
12
14
16
18
20
22
24
26
28
30
32
3

12
14
20
22
34
36
38
42
44
46
48
50
52
54
56
58

14
16
20
22
34
36
38
40

12
14
16
44
46
54
56
58

CLEATED SOLE FOR ACTIVEWEAR SHOE

TECHNICAL FIELD OF THE INVENTION

This invention relates in general to activewear shoes, and more particularly relates to sole constructions for such shoes.

BACKGROUND OF THE INVENTION

Cleats for athletic and other activewear shoes are well known in the art. Conventionally, such cleats have been provided in order to provide a maximum gripping of the bottom surface of the shoe to a playing surface such as grass or soil. Some cleats have been formed integrally with the outsole of the shoe, while other cleats have been of the "screw in" type. These cleats, which are usually of metal or hard nylon, can be removed after play. In general, however, these cleats have been provided as gripping elements only.

More recently, advances in the shoe art and in the sports industry in general have mandated that shoes become lighter and lighter in weight, while maintaining the same amount of durability as has been heretofore available. A limitation is particularly imposed on the weight of the shoe due to the construction of the outsole, which generally has to be made of a relatively hard, durable, dense and heavy material, such as natural rubber. It has been found by experimentation that the forming of an outsole out of lighter materials, such as a dense foam rubber, will produce an outsole which shows an unacceptable amount of wear within a short time.

Therefore, a need has arisen in the industry for the provision of a sole construction for an activewear shoe which is lightweight, but which at the same time is durable.

SUMMARY OF THE INVENTION

This need has been met by a novel sole construction comprising the invention. This sole construction includes an outsole and a cleat layer generally disposed above the outsole. A plurality of cleats are formed on the cleat layer and depend downward therefrom and are received in respective perforations in the outsole. Thus, the exterior bottom surface of the shoe to which the sole construction is attached comprises the cleats, which are preferably of a durable, resilient, long wearing material, and the outsole, which preferably is of a lighter weight and more flexible material.

In a preferred embodiment, the sole construction of the invention is used to form a portion of shoe, which further comprises an upper and a midsole. An upper surface of the midsole is attached to the upper, and a bottom surface thereof is joined to the cleat layer. The cleat layer has a substantially flat member joined to the midsole bottom surface and has a plurality of cleats integrally formed on the flat member. The outsole is directly joined to this flat member. A plurality of perforations are formed in the flat member spaced from the cleats in order to reduce the weight of the flat member and save costs in constructing this layer.

In a particularly preferred walking-shoe embodiment, the midsole is joined to the upper in a central area of the upper surface of the midsole, while an elongate welting member is attached to the periphery of the midsole.

BRIEF DESCRIPTION OF THE DRAWINGS

A more complete understanding of the invention will be obtained by referring to the following detailed description when studied in company with the attached drawings, wherein.

DETAILED DESCRIPTION OF THE ILLUSTRATED EMBODIMENT

Figure 1:
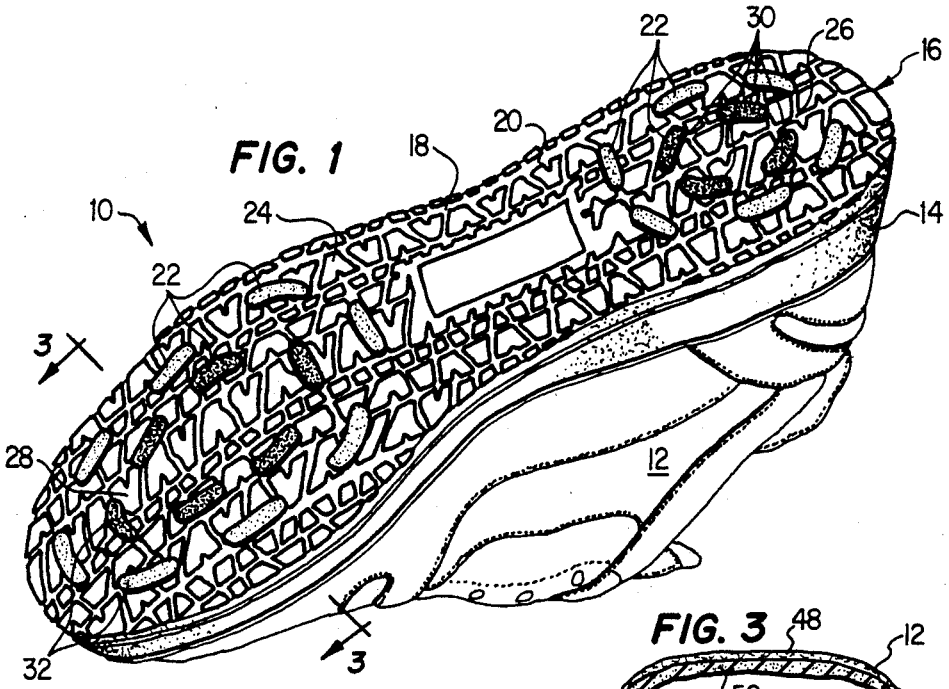
FIG. 1 is a bottom perspective view of an activewear shoe incorporating a sole construction according to the invention.

Turning now to the drawings, FIG. 1 illustrates an activewear shoe incorporating the invention and indicated generally at 10. The activewear shoe shown is in particular a walking shoe, but it should be understood that the invention is capable of being employed in any of a number of other athletic shoes, such as court shoes, running shoes or hiking shoes. Shoe 10 includes an upper 12, formed out of a suitable material such as leather or the like. Upper 12 is joined to a midsole 14, which is preferably formed of a cushionable material such as ethylene vinyl acetate copolymer (EVA).

A sole construction indicated generally at 16 is joined to midsole 14. Sole construction 16 has a bottom surface 18 that comprises two elements: an outsole 20 and a plurality of cleats 22. Outsole 20 extends over most of the area of bottom surface 18 and preferably comprises a lightweight, flexible layer of material, such as a dense foam rubber. Outsole 20 preferably has a tread pattern 24 formed therein in order to aid the wearer's grip on the walking or playing surface.

Cleats 22 are preferably formed in a heel area 26 and a forefoot area 28 of bottom surface 18. Areas 26 and 28 respectively correspond to the heel and forefoot regions of the wearer's foot, where the most downward pressure is applied during walking or running. Cleats 22 are preferably formed of a hard, durable, resilient material, such as natural rubber, and provide long-lasting wear surfaces for bottom surface 18.

A particularly efficacious arrangement of cleats 22 is to dispose them in concentric elliptical sets as shown. Two concentric sets 30 are disposed around a center of heel region 26, and another two concentric sets 32 are disposed around a center of forefoot region 28. Cleats 22 preferably take an elongate, avoid form as shown, but other forms may be used.

Figure 2:
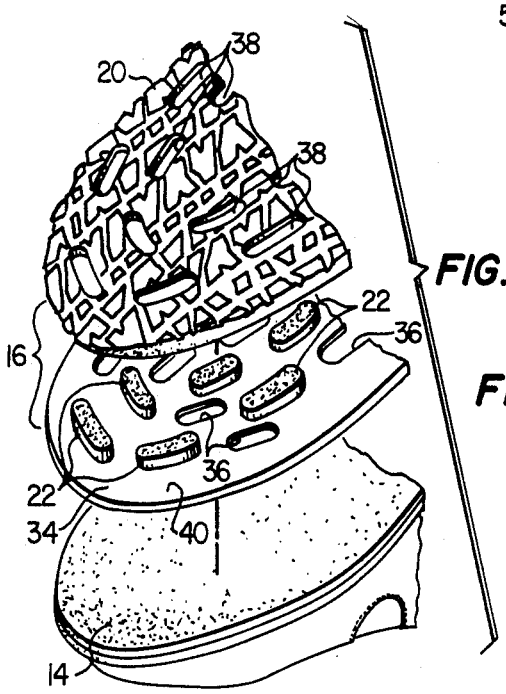
FIG. 2 is a partial exploded view of the sole construction of the invention as shown in FIG. 1, showing details of a cleat layer and the registration of cleats within respective holes of an outsole layer.

Turning now to FIG. 2, an exploded view of the sole construction illustrated in FIG. 1 is shown. Sole construction 16 comprises outsole 20 and a cleat layer 34 that is in general disposed above outsole 20. Cleat layer 34 is preferably integrally formed of natural rubber, and comprises a flat member 40 and a plurality of cleats 22 preferably integrally formed thereon. In a preferred embodiment, cleat layer 34 has a plurality of perforations 36 laterally spaced from cleats 22. Perforations 36 are formed in cleat layer 34 in order to save weight and material cost. Perforations 36 may take various forms, the elliptical forms shown being only exemplary.

Each cleat 22 is formed to be closely received by a respective perforation 38 in outsole 20. Cleats 22 are each of a sufficient height from flat member 40 that they will protrude all the way through perforations 38 and project downwardly below the general surface of outsole 20, providing wear-resistant surfaces for bottom surface 18. As shown, outsole 20 is joined to cleat layer 34, and these two members are in turn joined to the remainder of shoe 12, in particular the bottom surface of midsole 14.

Cleats 22 may be of contrasting colors. The provision of cleats as integral members of a cleat layer 34 allows them to be molded of an entirely different color from the color of outsole 20. For instance, outsole 20 may be black, while cleat layer 34 may be molded out of a blue natural rubber. Certain cleats 22 may be formed by injecting the mold with a different color rubber in certain areas, or may be painted before assembly to outsole 20, in order to provide a second contrasting color, such as red. In this way, a more pleasing and attractive appearance of the outsole is obtained than has heretofore been feasible.

Figure 3:
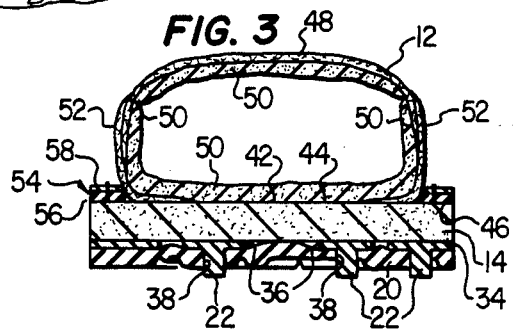
FIG. 3 is a lateral cross-section of the shoe taken substantially along lines 3—3 of FIG. 1.

Turning now to FIG. 3, a lateral, frontward-looking section taken substantially along section 3—3 of FIG. 1 is shown. As shown, the perforations 38 of outsole 20 and cleats 22 are in close-fitting registry, and cleat layer 34 is preferably glued to outsole 20. An upper surface of cleat layer 34 is then attached as by gluing, to a bottom surface of midsole 14. Midsole 14 has an upper surface 42 that has a central area 44 and a peripheral area 46. Upper 12 is attached as by gluing to central area 44. Upper 12 has an exterior layer 48 that is preferably comprised of leather in the illustrated walking-shoe embodiment, but may also be comprised of other conventional materials. Upper 12 may also have any number of padded layers 50 for cushioning support of the wearer's foot. As composed of exterior layer 48 and padded layers 50, upper 12 has a plurality of sidewalls 52 that are formed in an upstanding fashion.

The peripheral area 46 of midsole 14 extends outwardly from central area 44 in order to provide an area for attachment of an elongate welting member 54. As shown, welting member 54 comprises a lower member 56 that is preferably glued to the peripheral area 46 of upper surface 42, and an upper layer 58 that is stitched to lower layer 56. Welting member 54 serves two purposes. First, it provides some measure of support for upstanding sidewalls 52. Second, it provides a decorative feature emulating the more functional welting of prior art leather shoes, while allowing for modern activewear shoe assembly techniques.

Figure 4:
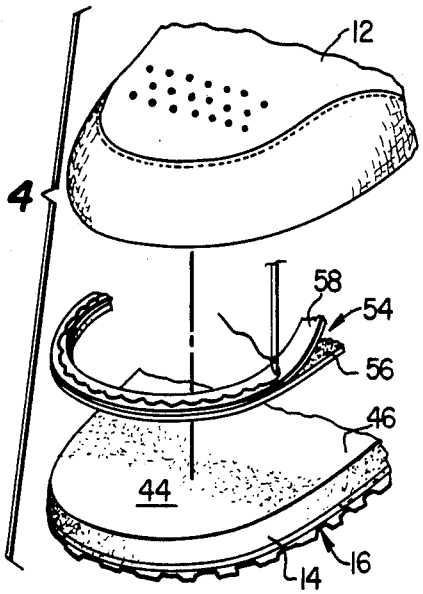
FIG. 4 is a partial exploded view of the shoe shown in FIG. 1, showing the relative placement of the upper and an elongate welting member on the midsole.

Turning now to FIG. 4, the forefoot region of shoe 10 is shown in an exploded view in order to depict the relationship among upper 12, welting member 54, midsole 14, and sole construction 16. Upper 12 is joined as by gluing to central area 44 of midsole 14, while welting construction 54 is attached as by gluing to peripheral area 46 of midsole surface 42.

In summary, an improved sole construction has been disclosed that comprises an outsole made out of a light weight flexible material, and a plurality of cleats registering in respective perforations of the outsole. The cleats are preferably made of a more durable and resilient material than the outsole, providing wear-resistant surfaces for the bottom surface of the shoe. The sole construction of the invention may be combined with a novel welting construction in order to produce a superior walking-type shoe.

While a preferred embodiment of the invention has been described and illustrated, the invention is not limited thereto, but only by the spirit and scope of the claims which follow.

What is claimed is:

1. A shoe comprising:

an upper;

a midsole for attachment to said upper and having a midsole bottom surface;

a cleat layer having a substantially flat member joined to said midsole bottom surface, said cleat layer further comprising a plurality of cleats formed on said flat member and depending therefrom; and an outsole for disposal beneath and joined to said flat member and having a plurality of perforations each in registry with a respective cleat, each cleat inserted through a respective perforation, a bottom surface of the shoe formed by said outsole and said cleat;

said outsole including heel and forefoot areas corresponding to the heel and forefoot of the foot of the wearer, a first concentric set of said cleats formed about a center in said heel area, a second concentric set of said cleats formed about a center in said forefoot area, such that said concentric sets are disposed to receive the main weight of the wearer.

2. The shoe of claim 1, wherein said concentric sets of said heel area and said forefoot area each have two concentric rings of said cleats.

3. A shoe comprising:

an upper;

a midsole for attachment to said upper and having a midsole bottom surface;

a cleat layer having a substantially flat member joined to said midsole bottom surface, said cleat layer further comprising a plurality of cleats formed on said flat member and depending therefrom; and an outsole for disposal beneath and joined to said flat member and having a plurality of perforations each in registry with a respective cleat, each cleat inserted through a respective perforation, a bottom surface of the shoe formed by said outsole and said cleats, said cleats fabricated in at least one color contrasting with the color of said outsole.

4. A shoe comprising:

an upper;

a midsole for attachment to said upper and having a midsole bottom surface;

a cleat layer having a substantially flat member joined to said midsole bottom surface, said cleat layer further comprising a plurality of cleats formed on said flat member and depending therefrom;

an outsole for disposal beneath and joined to said flat member and having a plurality of perforations each in registry with a respective cleat, each cleat inserted through a respective perforation, a bottom surface of the shoe formed by said outsole and said cleats and said flat member layer having a plurality of perforations laterally spaced from said cleats in order to reduce the weight and cost of said clear layer.

5. A shoe comprising:

an upper;

a midsole for attachment to said upper and having a midsole bottom surface, said midsole comprising ethylene vinyl acetate copolymer and having an upper surface joined to said upper, an elongate welting member of said upper formed peripherally around said upper and joined to the periphery of said midsole upper surface;

a cleat layer having a substantially flat member joined to said midsole bottom surface, said cleat layer further comprising a plurality of cleats formed on said flat member and depending therefrom; and an outsole for disposal beneath and joined to said flat member and having a plurality of perforations each in registry with a respective cleat, each cleat inserted through a respective perforation, a bottom surface of the shoe formed by said outsole and said cleats.

6. A method for forming a shoe having a plurality of cleats on a bottom surface thereof, comprising the steps of:

integrally forming the cleats on a cleat layer;

forming perforations in said cleat layer laterally spaced from said cleats in order to reduce the weight and manufacturing cost thereof;

forming a plurality of perforations in an outsole equal to the plurality of cleats;

inserting each of the cleats through a respective perforation;

joining the cleat layer to the outsole; and joining the outsole and cleat layer to a remainder of the shoe.

* * * * *